United States Patent [19]

Huang

[11] Patent Number: 4,673,007

[45] Date of Patent: Jun. 16, 1987

[54] AIR AND LIQUID PUMP FOR CUSHION SHOES, COMBINED A PRESSURE SCALE AND A BALL PEN

[76] Inventor: Ing-Chung Huang, No. 15 Reh-Her 1st Street, Kaohsiung, Taiwan

[21] Appl. No.: 907,457

[22] Filed: Sep. 15, 1986

[51] Int. Cl.[4] ..... B65B 3/04

[52] U.S. Cl. ..... 141/95; 141/98; 92/145; 222/192; 401/52; 401/195; 417/313; 417/545

[58] Field of Search ..... 141/1-12, 141/37-66, 94, 95, 96, 67, 68, 114, 313-317; 417/313, 545-554; 401/52, 195; 222/192; 92/145

[56] References Cited

U.S. PATENT DOCUMENTS

| | | | |
|---|---|---|---|
| 567,407 | 9/1896 | Petrie | 417/313 |
| 1,317,817 | 10/1919 | Ogilvy | 401/195 |
| 2,489,976 | 11/1949 | Perwas | 417/313 |

*Primary Examiner*—Houston S. Bell, Jr.
*Attorney, Agent, or Firm*—Kirschstein, Kirschstein, Ottinger & Israel

[57] ABSTRACT

This invention concerns a kind of air liquid pump particularly used for cushion shoes, combined with a pressure scale and a ball pen. It is portable and can indicate the pressure of the inflated air or liquid and can be also used as a pen.

10 Claims, 9 Drawing Figures

AIR AND LIQUID PUMP FOR CUSHION SHOES, COMBINED A PRESSURE SCALE AND A BALL PEN

BACKGROUND OF THE INVENTION

So far there is no suitable pump on market to inflate the cushion shoes whose patent this inventor has filed an application for in U.S.A., Japan, Korea, Australia and Europe, and acquired in ROC. At the present time, the cushion shoes are inflated by the conventional bicylce air pump. But because it can't tell the pressure shoes get inside, it easily gives unbalanced pressure for the right and left one, which results in hampering the user form getting the ideal buffer elasticity expected for the shoes. Therefore, such a pump is not proper for inflating the cushion shoes. Even though equipped with a pressure gauge, the conventional pedal pump is actually too large to carry with. So the inventor has worked hard to provide the present invention which has the characteristics listed below.

1. The structure is concise for easy carring.
2. A pressure scale is equipped for measuring the air pressure shoes get.
3. It can be also used as a pen for writing.
4. It can be also used for inflating balls.

SUMMARY OF THE INVENTION

This invention concerns a kind of air pump portable and possible to indicate the pressure of the inflated air or liquid and to be also used as a pen for writing.

It includes a hollow bar which connects with a head ring, a pen head base and a tubular cover at its front end and with a connecting ring, a pressure measuring valve, a rubber gasket, a pressure measuring base, a needle base and a connecting ring at its back end. The hollow bar receives a piston in it, while the piston receives a pen in its hollow way.

DETAILED DESCRIPTION OF THE INVENTION

Figure 1:
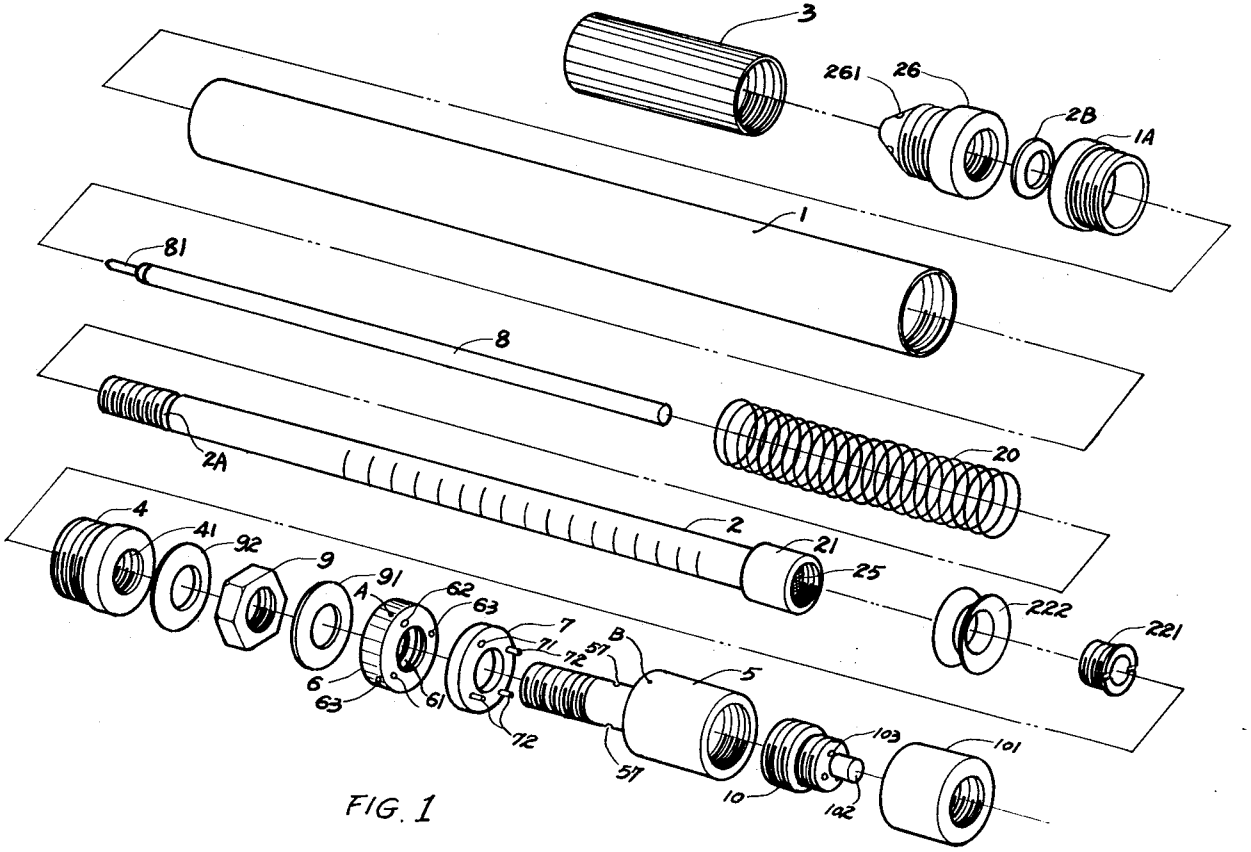
FIG. 1 is the analytical view of the air pump for cushion shoes combined with a pressure scale and a ball pen in this invention.
Figure 4:
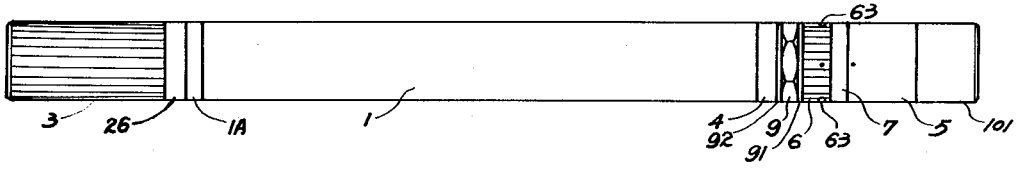
FIG. 4 is the front view of the whole body of the air pump in this invention.
Figure 5:
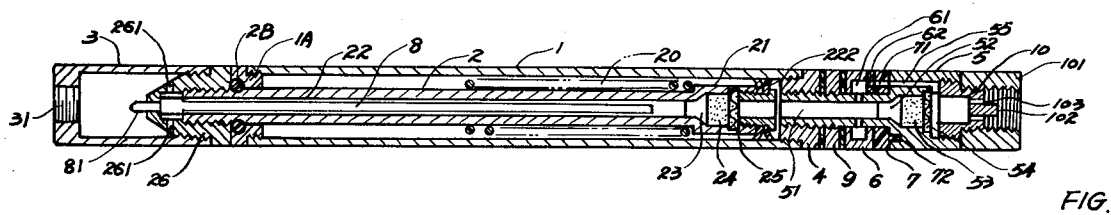
FIG. 5 is the A—A cross-sectioned view of the FIG. 4.

As shown in FIGS. 1,4,5, this invention includes a hollow bar 1 for a piston 2 to extend into or out. The hollow bar 1 is screwed at its front end together with a cap 1A which is bored at its center with a hole that is diametrically a bit bigger than the piston 2 but smaller than a piston head 21 so that the piston can penetrate through the hole and be stopped at its head 21. In addition, a low edge set at the inside front of the cap 1A is to receive a rubber ring 2B for fixing the piston 2. At the back end of the bar 1, a matching ring 4 is set for screwing with a pressure measuring base 5; a measuring valve 6, a anti-leak rubber gasket 7 etc. are also combined together between them, in the course of screwing the ring 4 and the base 5.

The back part of the piston 2 is cut with scales for indicating the air pressure and matched with a spring 20 (for measuring pressure) of the length one half or one third of that of the piston 2. The central interior of the piston 2 is a hollow way 22 for air or liquid to flow through and for a pen rod 8 to stay in. The conical back end of the hollow way 22 is to match with a one-way valve 23 which is successively to connect with a sponge 24 and a sieve screen 25; a hollow bolt 221 screws with the thread cut at the end of the hollow way 22. Leaned on the hollow bolt 221, a two-way non-return cover 222 is fixed to prevent the air or liquid from leaking, and give a sealing effect with a low resistance while the piston is moving to and fro to pump air able to attain a pressure up to 150 psi. The front end of the piston 2 extending out of the bar 1 is set with a ring slot 2A, which is to receive a rubber ring 2B that can be inserted into the slot of the cap 1A when this pump is not being used, so the piston 2 won't extend outwards by itself. And the end of the piston 2 is screwed with a head base 26 that has a hollow way at its center for a pen head 81 to fit in; air holes 261 bored in the head base 26 are for air to be sucked into the hollow way and then through the way 22 of the piston 2 into the bar 1 when the piston 2 is pulled outwards. In addition, the head base 26 is screwed together with a tubular cover 3 that has a screwed hole 31 at its front end for connecting with a tube in order to provide special gas or liquid.

The end of the bar 1 is screwed steadily with a matching ring 4 that has s screwed hole 41 at its center for screwing together with a pressure measuring base 5.

Figure 2:
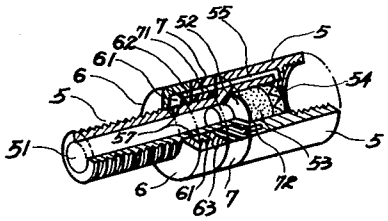
FIG. 2 is the view of the combination of the pressure measuring base, the measuring valve and the anti-leak gasket in this invention.

As shown in FIG. 2, a nut 9, a measuring valve 6 and a rubber gasket 7 are put between the bar 1 and the matching ring 4; gaskets 91,92 sealed respectively between the nut and the measuring valve 6 and between the nut 9 and the matching ring 4 are used to prevent leaking. The pressure measuring base 5, as shown in FIG. 2, is a tube which has a smaller outer diameter for its front half part and a bigger one for its back half part, and a hollow way 51 at its center containing a one-way valve 52, a sponge 53 and a sieve screen 54. Screwed with the outer thread at the front end of the pressure measuring base 5 is the matching ring 4 and with the inner thread in a hollow way 51 of the measuring base 5 is a needle base 10 which can be used for connecting with a tube pressure gauge and a needle.

In addition, set at one side of the sieve screen 54 is a reverse L-shaped way 55 for decreasing pressure or reversely releasing air while measuring the pressure.

The rubber ring 7 fixed at the front part of the pressure measuring base 5, as shown in FIG. 2, has a hole 71 and three fixing pins 72 on its circular back surface so as to fit in holes 56 in the front surface of the back part of the base 5. The hole 71 faces against the exit of the reverse L-shaped way 55.

The measuring valve 6 fixed also at the base 5 is a metallic ring which is set with a ring slot 61 on its inner surface; an air hole 62 is dug through to the ring slot 61 and two air ways 63 which do not communicate with the ring slot 61 are set respectively 90 degrees away from the air hole 62 at its two sides. In order to arrange the air hole 62 and the hole 71 and the reverse L-shaped way 55 in a line for air return and measuring, a mark A or the valve 6 and a mark B on the base 5 must be correctly located. When one of the air ways 63 is placed to face against the B mark on the base 5, the other air way 63 is to face the hole 71 of the rubber ring 7 so that the reversely released air from the way 55 is directly released from the air way 63 to decrease the pressure.

After fixing the measuring valve 6 on the base 5, two air holes 57 in the base 5 are to face against the ring slot 61 so that the ring slot 61 may communicate with the hollow way 51 of the base 5 for the reversely released air to flow into the bar 1 to push the piston 2, which extends out accordingly to indicate the pressure.

Figure 3:
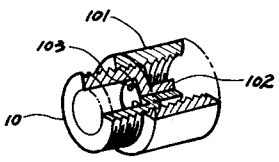
FIG. 3 is the view of the needle base in this invention.

The needle base 10, as shown in FIG. 3, to be screwed with the interior thread of the base 5, is shaped as two stages of different diameter. The needle base 10 utilizes the outer thread of its big part to screw with the base 5 and that of its small part to screw with a connecting ring 101 which, in addition to screwing together with the needle base 10, is to screw with a needle 11 or an air valve of a bike tube. Set at the center of the back wall of the needle base 10, a rod 102 made of metal is bored with a plurality of air holes 103 which are for air to flow between the needle 11 and the base 5 when the connecting ring 101 is screwed with a needle. And when the conecting ring 101 is screwed with the air valve of a bike tube the rod 102 will push the valve open to force the air in the tube to leak out so as to measure the air pressure in it.

The practical use of this invention is described as follows.

Figure 6:
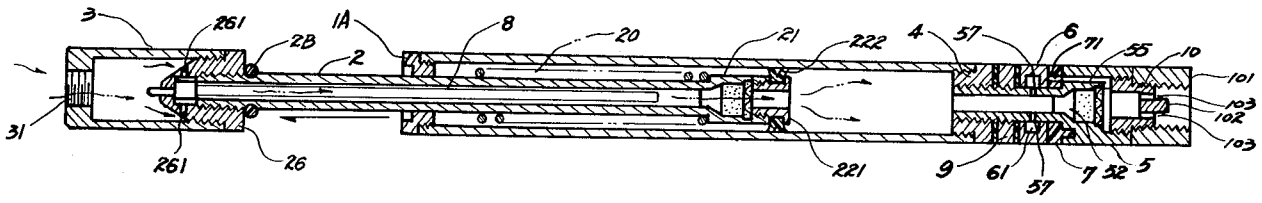
FIG. 6 is the view of sucking air in this invention.

When a cushion shoe (or a ball) is to be inflated, first turn around the valve 6 to make the mark A and the two air ways 63 not face against the mark B on the base 5, so the air hole 62 and the hole 71 of the rubber ring 7 are placed not in face to face. Then, if you hold the tubular cover 3 and pull out the piston 2, air will be sucked in through the air holes 261 of the head base 26 into the hollow way 22 of the piston 2 and then go through the one-way valve 23 into the bar 1. At this moment, the one-way valve 52 of the base 5 is closed as shown in FIG. 6.

Figure 7:
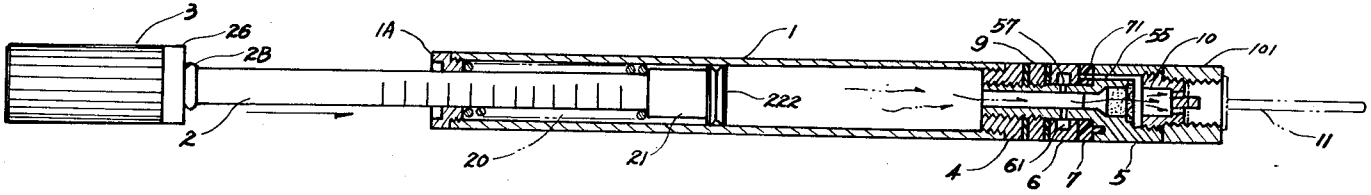
FIG. 7 is the view of inflating air in this invention.

Next, as shown in FIG. 7, when the piston 2 is pushed inwards, the one-way valve 23 is closed and the air will be pushed ahead to open the one-way valve 52 and flow through the needle into the cushion shoe or ball.

Figure 8:
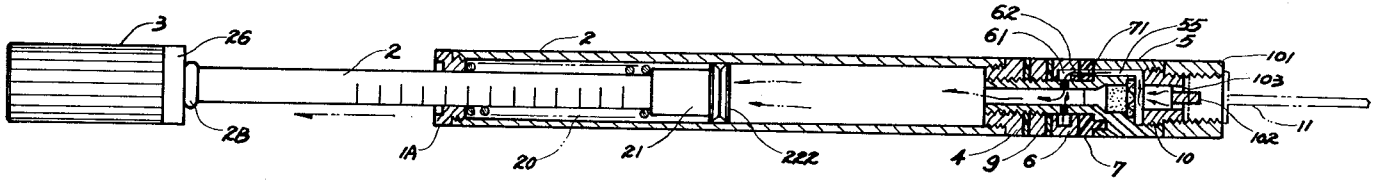
FIG. 8 is the view of measuring air pressure in this invention.

In addition, FIG. 8 is an implying view of measuring the pressure. First, the needle connected with a needle base 10 is to be inserted into the valve of a cushion shoe or a ball or the connecting ring 101 is directly connected with a tube valve, then turn around the valve 6 to make the mark A face against the mark B, which makes the hollow way 22, the air hole 62 and the ring slot 61 communicate with each other, so the air will deture through the reverse L-shaped way 55, the ring slot 61 of the valve 6, air holes 57, the hollow way 51 of the base 5 and then the one-way valve 52 into the bar 1; finally the air pushes out the piston 2, and, via the resistance of the spring 20, the pressure of the inflated air can be indicated by the scale on the exposed part of the piston 2.

Figure 9:
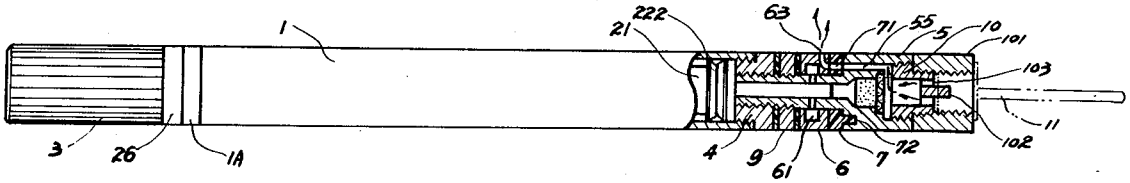
FIG. 9 is the view of decreasing air pressure by releasing air out in this invention.

FIG. 9 is an implying view of decreasing the pressure. First, turn around the valve 6 to make one of the air ways 63 face against the mark B on the base 5, and the other air way 63 will naturally face against the reverse L-shaped way 55 so that the air flowing reversely will flow through the way 55 and run out of the air way 63 of the valve 6 into the atmosphere directly. If the object to be inflated should be quite spacious, it can first be inflated by liquidized nitrogen stored in a steel bottle to a certain low pressure, and then be inflated to the needed pressure by this invention, which can save time in inflating the object.

I claim:

1. A sort of air and liquid pump for cushion shoes combined with a pressure scale and a ball pen comprising, a hollow bar which has its front end screwed with a cap that has a hollow hole at its center for a piston to penetrate through and its back end screwed with a matching ring that is successively screwed with a pressure measuring base by means of its interior thread that is to receive in order a rubber gasket, a nut, a rubber gasket, a measuring valve and a rubber gasket, a piston which lies in said bar and can extend into or out of its front end; the interior of said piston is a hollow way which has a conical opening at its end for connecting with a one-way valve that is successively connected with a sponge and a sieve screen; the end of said hollow way is screwed with a hollow bolt so as to fix a two-way non-return cover at the end of said piston; the front end of said piston is screwed with a head base so as to fix the head of a pen rod received in said hollow way of said piston; a ring slot set at the edge of said piston connected with said head base is to receive a rubber ring that is then to be inserted in said cap for keeping said piston stay in place while said piston is not used, a head base which is screwed at the front end of said piston and bored with air holes in it and set with thread on its outer surface for screwing with a tubular cover which has inner thread on its front part so as to connect a tube supplying gas or liquid, a matching ring which is screwed at the end of said bar and set with thread on its inner surface for screwing with a pressure measuring base, a pressure measuring base which is shaped as a tube with a smaller diameter for its front part and a bigger one for its back part; the end of the front part is set with thread for screwing with said matching ring; the front part is mounted in order with a gasket, a nut, a gasket, a measuring valve and a rubber ring; the interior of said base is a hollow way which has a conical opening at its middle for connecting with a one-way valve which is successevely assembled with a sponge and a sieve screen; the inner end of said hollow way is set with thread for screwing with a needle base; in the wall of the back part of said base, there is a reverse L-shaped air way which has its exit located at the front wall of the part with a bigger diameter that is also bored with three holes for receiving three pins on a rubber ring; in addition, the front part of said base where the measuring valve is to be assembled with is bored with two air holes communicating with said hollow way of said base, a pressure measuring valve mounting on said pressure measuring base and having a hole at its center; the inner surface of said hole is cut with a ring slot; an air way is bored in one side wall of said measuring valve leading to said ring slot and two other air ways are bored as well in the side wall with 90 degrees away from two sides of said air way and not communicating with said ring slot, a rubber gasket set between said measuring valve and the front wall of the bigger part of said pressure measuring base and having a hole that is to face against said air way of said base and the three pins on its back surface that are to fit in said holes of said base, a needle base shaped as a hollow rod and set with thread on its surface for screwing with said pressure measuring base and a connecting ring; the center of the back wall of the needle base is set with a rod which is bored with four air holes; said connecting ring has interior thread for screwing with a needle or a tube valve, and having characteristics that when said measuring valve is rotated to make its air holes not face against said air way and said hole of said rubber gasket; said piston can move to and fro to push air and when said air hole of measuring valve is moved to face against said hole of said rubber gasket, inhaled air may run reversely into the interior of said bar so as to push out said piston for measuring the pressure; when one of said air ways is turned to face against said hole of said rubber gasket, the air can be released from said air way for decreasing the air pressure.

2. An air and liquid pump for cushion shoes combined with a pressure scale and a pen as claimed in item 1, wherein said piston has a pressure graduation on its surface and is mounted with a spring which is one half or one third as long as the piston.

3. An air and liquid pump for cushion shoes combined with a pressure scale and a pen as claimed in item 1, wherein the one-way valve in said piston is opened but that in said pressure measuring base is closed when said piston is pulled outward to suck in air but when said piston is pushed inward, the one in said piston is closed and that in said base is opened.

4. An air and liquid pump for cushion shoes combined with a pressure scale and a pen as claimed in item 1, wherein the exit of the inner end of said piston is set with a two-way non-return cover fixed by a hollow bolt; said cover is shaped as two turmpets combined together.

5. An air and liquid pump for cushion shoes combined with a pressure scale and a pen as claimed in item 1, wherein said pressure measuring base set at the rear part of said hollow bar is shaped as a tube that has smaller diameter for its front part and a bigger one for its back part and is attached with a one-way valve, a sponge and a sieve screen in its inner hollow way; on the inner wall of the end of said bigger part there is thread for screwing with said needle base; an air way is set in the wall between said thread and said sieve screen and bored with an exit at the front wall of said bigger part; at the front part of said smaller part, there are air holes bored through the tube wall to said hollow way and said air holes are to face against said ring slot of said measuring valve; at the part of said hollow way between said air holes and the entrance of said air way is put said one-way valve, sponge and sieve screen.

6. An air and liquid pump for cushion shoes combined with a pressure scale and a pen as claimed in item 1, wherein said pressure measuring valve is a hollow ring that has a ring slot on its inner surface and at least one air hole bored through its wall to its ring slot and one air hole not communicating with ring slot on its inner wall.

7. An air and liquid pump for cushion shoes combined with a pressure scale and a pen as claimed in item 1, wherein said anti-leak gasket set between said measuring valve and the front wall of the bigger part of said pressure measuring base has a hole bored through its wall and located to face against the exit of said air way; by turning said measuring valve said hole can also face against said air hole or either of said air holes of said measuring valve; the pins of said rubber gasket are to insert into and to be adhered to said holes in said front wall of said pressure measuring base.

8. An air and liquid pump for cushion shoes combined with a pressure scale and a pen as claimed in item 1, wherein said needle base has outer thread for screwing respectively with said pressure measuring base and said connecting ring; the back wall of said needle base projects as a rod and is bored with a plurality of air holes.

9. An air and liquid pump for cushion shoes combined with a pressure scale and a pen as claimed in item 1, wherein when all parts, i.e. said hollow bar, tubular cover, connecting ring, measuring valve, rubber gasket, pressure measuring base and needle base are assembled together, this pump can be shaped as round, triangle, square, polygon or combination of these shapes.

10. An air and liquid pump for cushion shoes combined with a pressure scale and a ball pen as claimed in item 1, wherein a ball pen can be replaced by a fountain pen, a sign pen or a mechanical pencil.

* * * * *